US006716041B2

(12) United States Patent
Ferderer et al.

(10) Patent No.: US 6,716,041 B2
(45) Date of Patent: Apr. 6, 2004

(54) ROUND PLUG CONNECTOR FOR SCREENED ELECTRIC CABLES

(75) Inventors: Albert Ferderer, Espelkamp (DE); Hartmut Schwettmann, Rahden (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 10/410,995

(22) Filed: Apr. 10, 2003

(65) Prior Publication Data

US 2003/0194890 A1 Oct. 16, 2003

(30) Foreign Application Priority Data

Apr. 13, 2002 (DE) ..... 102 16 483

(51) Int. Cl.[7] ..... H01R 4/66
(52) U.S. Cl. ..... 439/95
(58) Field of Search ..... 439/95, 98, 96, 439/610

(56) References Cited

U.S. PATENT DOCUMENTS 3,015,794 A 1/1962 Kishbaugh ..... 339/14
5,310,359 A * 5/1994 Chadbourne et al. ..... 439/462
6,053,749 A * 4/2000 Masuda et al. ..... 439/98
6,116,955 A * 9/2000 Lazaro, Jr. ..... 439/610

FOREIGN PATENT DOCUMENTS

EP 0 653 804 11/1994 ..... H01R/4/24

* cited by examiner

*Primary Examiner*—Lynn Feild
*Assistant Examiner*—Phuong Dinh
(74) *Attorney, Agent, or Firm*—Hayes Soloway P.C.

(57) ABSTRACT

For connecting the cable shielding in screened electric cables in the case of a round plug connection, it is proposed that, for the purpose of making contact with the cable shield, a contact element is provided which is disposed between an insulating pressing/clamping part and an insulating body, an aperture through which the cable shield can be introduced being provided in the said contact element. Under these circumstances, the contact element is shaped in such a way that connection of the cable shield to a counterplug can take place by means of a contact part which is to be provided inside the plug connector housing, or by means of the electrically conductive outer cover of the plug connector, or via both methods.

5 Claims, 4 Drawing Sheets

ROUND PLUG CONNECTOR FOR SCREENED ELECTRIC CABLES

Figure 1:
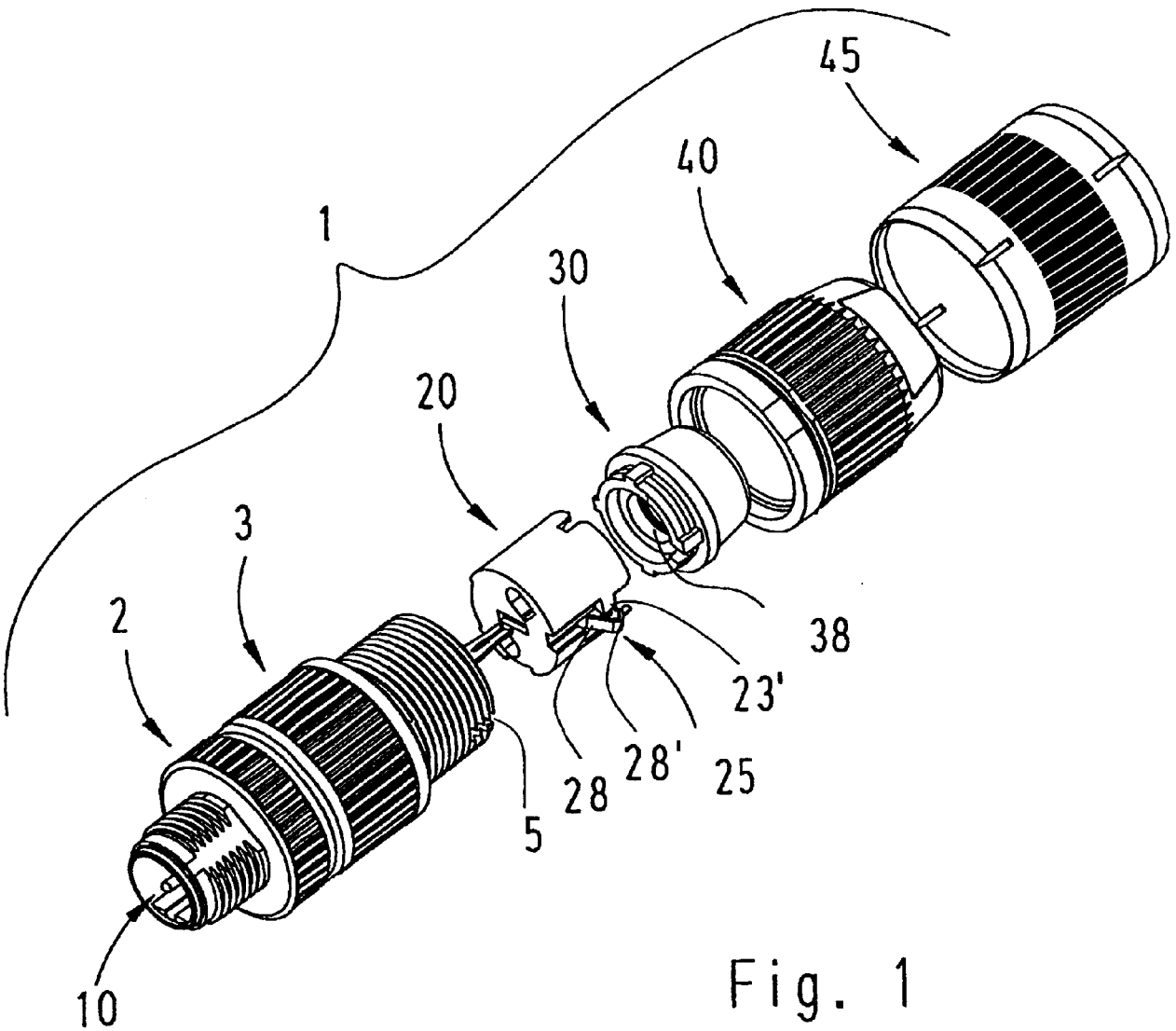

The invention relates to a round plug connector for screened electric cables, the said connector having an insulating body disposed in a carrier body and a cable screw fitting consisting of a pressing/clamping part and a metal screw bush, wherein the pressing/clamping part presses against the insulating body when the screw bush is screwed onto the carrier body.

A plug connector of this kind is needed in order to be able to utilise screened electric cables by means of a high-speed connection technique, instead of hitherto unscreened cables and leads which are connected to one another in non-critical regions by means of high-speed connection technology.

Plug connectors are known from the prior art, which pass on their screening to a counterplug either via a metal or metallised cover or via a central conductor. Thus, a cable entry in which a shielded cable is brought about by means of an electrically conductive sliding ring which makes contact with an electrically conductive pressure screw, is known from DE 198 37 530 C1.

The underlying object of the invention is therefore to construct a plug connector of the initially mentioned type to the effect that plug connectors with screened electric cables or conductors can be used even in the field of high-speed connection technology, it being possible to optionally pass on the screening via the metal outer cover, via an integrated central conductor or via both conductive parts simultaneously. Screening systems are to be produced via the central conductor or via the outer cover, according to different conditions.

This object is achieved through the fact that a contact element is provided for making contact with cable shielding on the electrical conductor, the said contact element being disposed on that side of the insulating body which points towards the cable connection; that the contact element in the form of a flat, bending part is provided with a bent-over, resilient end which engages over a projection which is provided in a recess disposed axially in the outer wall of the insulating body; that the contact element is provided with an aperture into which the cable shielding is introduced, the said cable shielding being received in the recess and clamped fast with the resilient end; and that the contact element with the bent-over, resilient end is disposed in such a way that, when the screw bush is screwed on, the bending edge of the resilient end presses against the inner wall of the said screw bush.

Advantageous refinements of the invention are indicated in claims 2 to 5.

The advantages achieved with the aid of the invention consist, in particular, in the fact that a plug connector which is already known can be fitted-out or converted by simple measures according to the invention, and that, when a contact element is employed, the shielding of an electrical conductor can be passed on to a counterplug via an electrically conductive outer cover or, for example, a conductor disposed in the centre of the plug connector, or via both. In that connection, a specially shaped contact element is integrated into an insulating body which is already known. Under these circumstances, one side of the contact element points to a contact part integrated into the insulating body, while the other side is provided with an aperture for the screening braid, which is to be twisted, of the shielded electric cable, and also with a bent-over, resilient contact end which grips the screening braid fast in a recess provided in the insulating body.

Under these circumstances, the bent-over, resilient contact end is shaped in such a way that it comes into contact with a metal screw bush surrounding the plug connector.

Figures 2A, 2B:
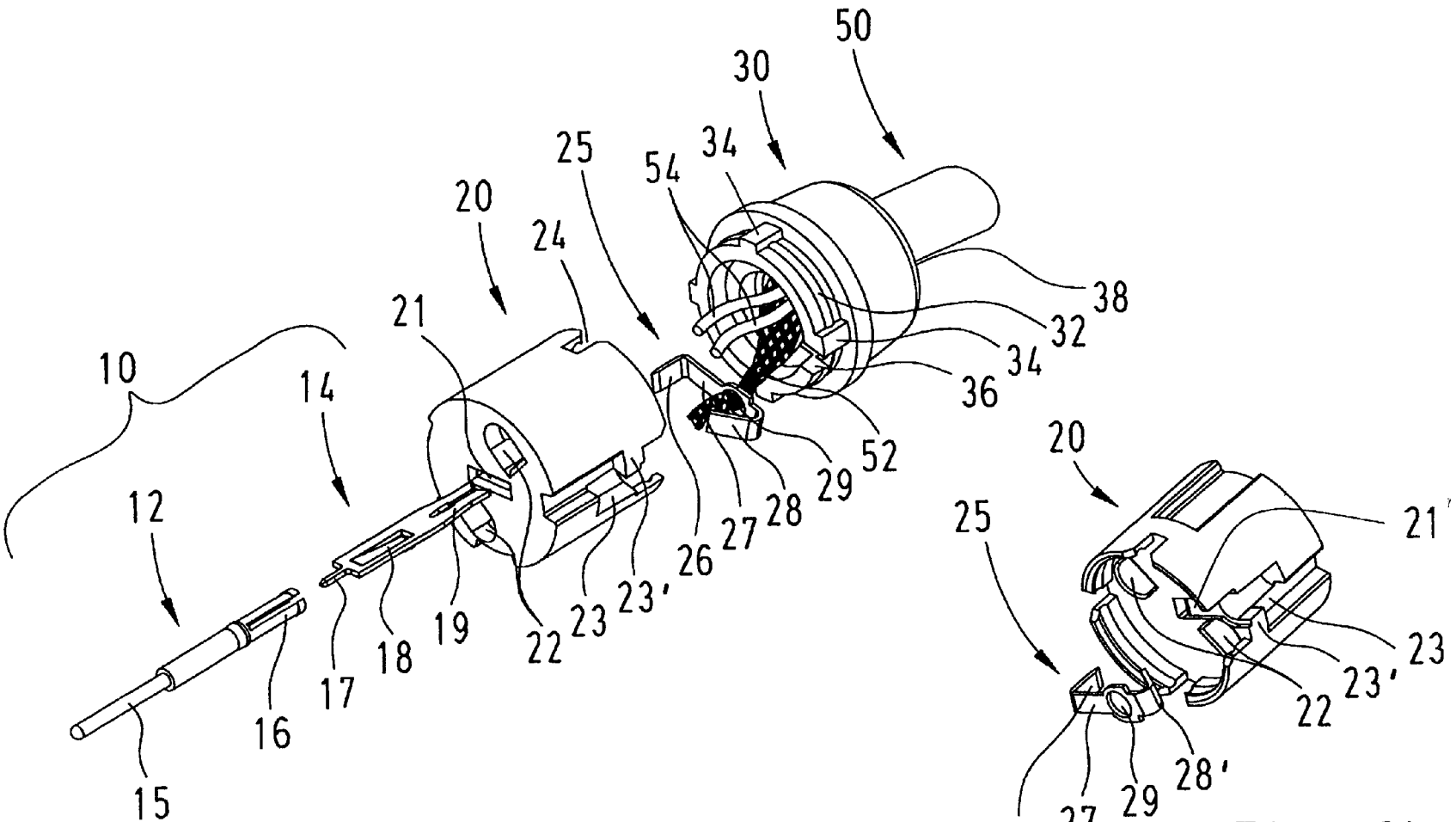
Figure 3:
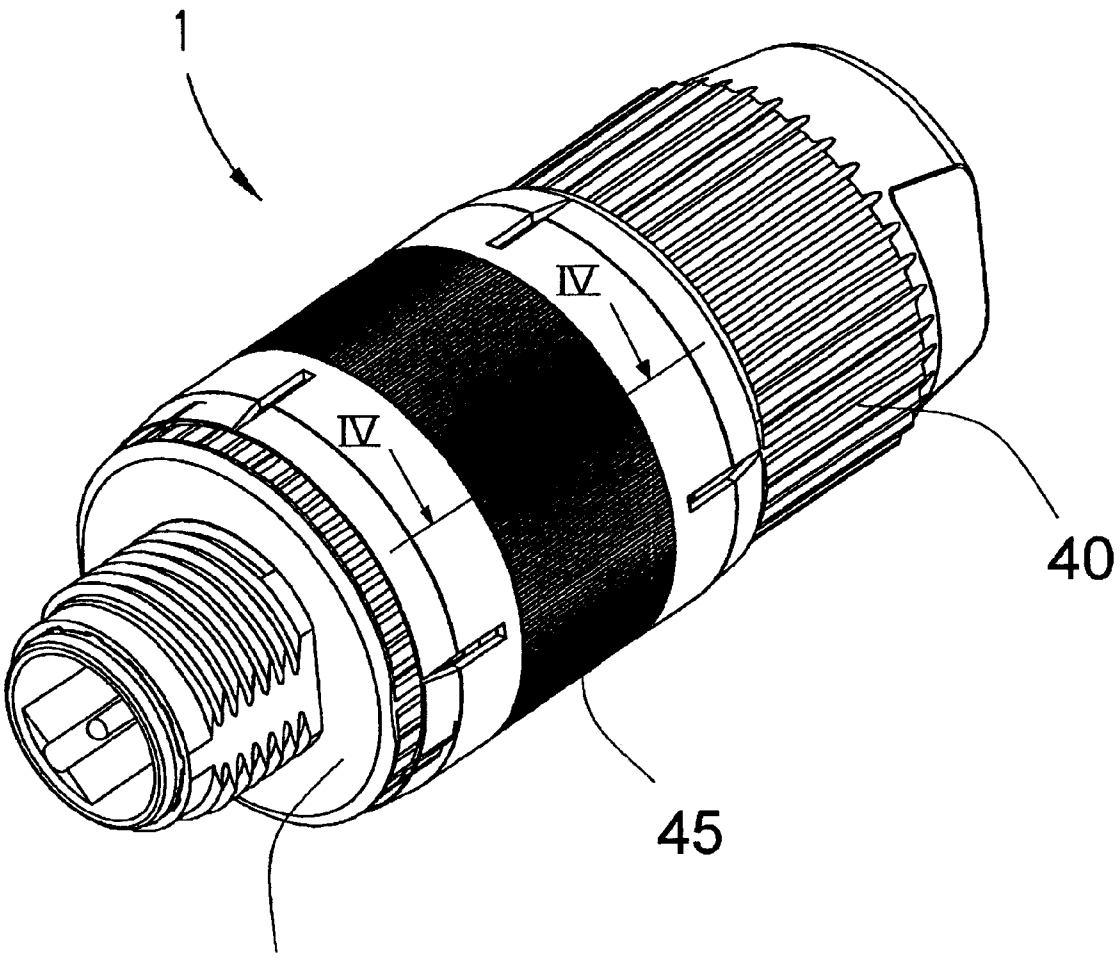

An exemplified embodiment of the invention is represented in the drawings and will be explained in greater detail below. In the said drawings:

FIG. 1 shows a round plug connector in an exploded representation;

FIG. 2*a* shows the electrical connection of the internal conductor, in an exploded representation;

FIG. 2*b* shows an insulating body with a contact element, rotated by 180° in relation to FIG. 2*a*; and FIG. 3 shows an isometric representation of a complete round plug connector.

Figure 4:
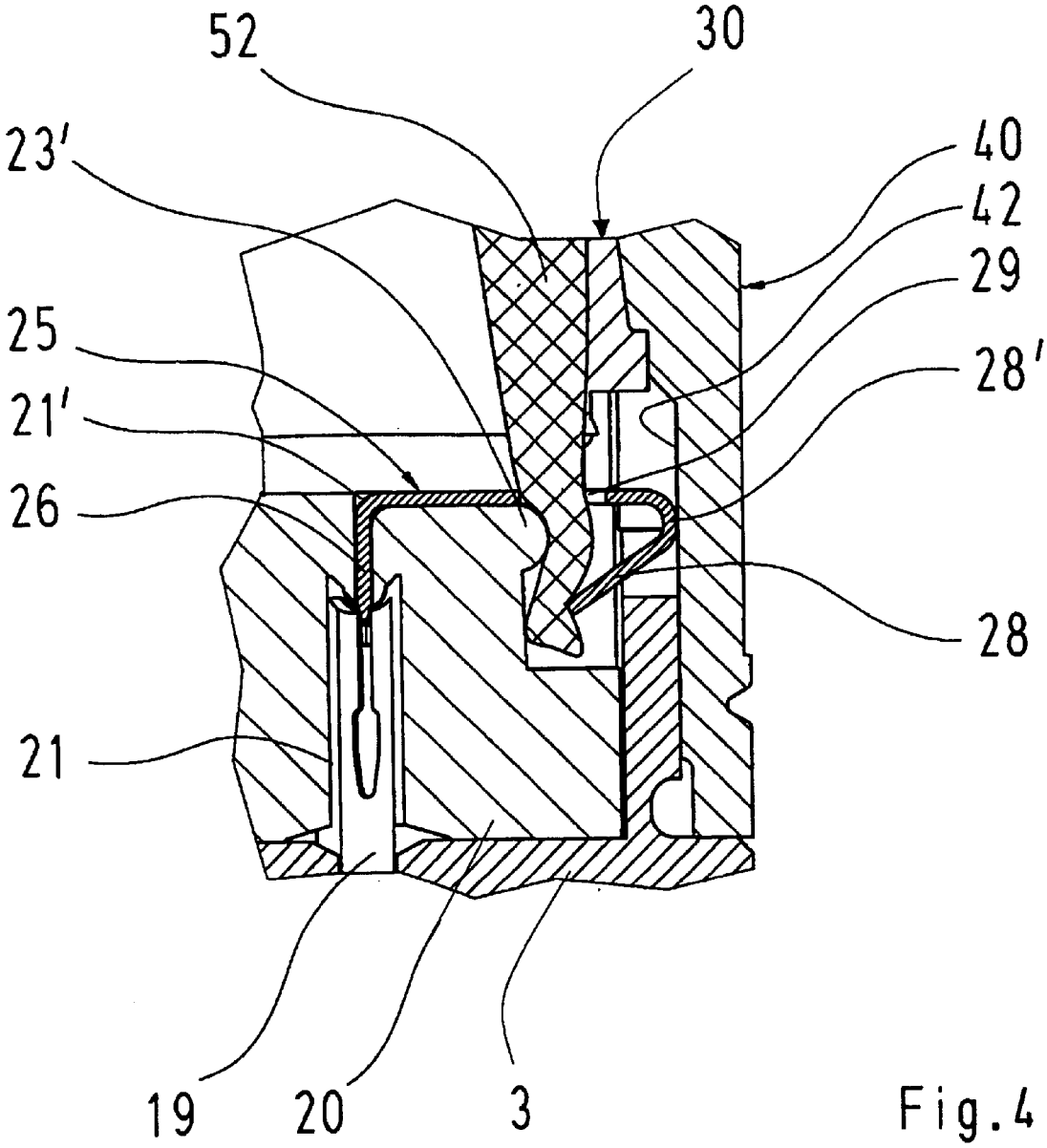

FIG. 4 shows an sectioned detail representation of the contact element in cooperation with other elements.

FIG. 1 shows a complete plug connector according to the invention, in an exploded, perspective representation. From bottom left to top right, the following parts are represented: First of all, a metal plug part 2, which can be screwed onto a counterplug, is lockingly engaged with an insulating carrier body 3 in which contact elements for signal transmission, of which elements no further details are represented here, are held. The contact part 10, whose insulation-piercing terminal 19 on the part 14 on the connection side points into a corresponding, slit-shaped receptacle 21 in an insulating body 20, is shown and specially emphasised. The insulating body, in which there are also provided conductor-guiding ducts 22 in which individual signal-carrying electrical conductors 54 are guided, is followed by a pressing/clamping part 30, with the aid of which the electric cable 50 is secured against being pulled out of the plug connector 1. A contact element 25, which will be explained later on, is inserted between the insulating body and the cable screw fitting. This is followed by a metal screw bush 40, with the aid of which the plug connector is held together after the said bush has been screwed onto the carrier housing 3, and also by a shielding bush 45 which, with suitable positioning, passes on the electrical contact from the screw bush 40 to the metal plug part 2 via the insulating carrier body 3.

FIG. 2*a* shows the contact part 10 already mentioned, with its significant individual parts. The contact part is formed from the two partial pieces constituted by a part 12 on the plug-in side and a part 14 on the connection side, although the said contact part may also be manufactured in one piece. The part on the plug-in side has a plug-in pin 15 for making contact with a counterplug, and a socket 16 in which a pin-shaped extension 17 on the part 14 on the connection side can be inserted. The part 14 is held fast in the insulating body 20 by means of a detent spring 18. The second side of the part on the connection side is constructed as an insulation-piercing terminal 19 into which the contact element 25 is pressed with an angled portion 26 provided for that purpose. The contact element 25 is constructed as a U-shaped, flat, bending part with an asymmetrically disposed round aperture 29 in the central region 27, an angled portion 26 which is bent aside by 90°, and a resilient end 28 which is bent over to at least 35° in relation to the said central region. In the course of assembly, contact with the contact element is made on the angled-portion side 26 in the receptacle 21 or with the aid of the insulation-piercing terminal 19 and the said contact element is clamped in on the other side in the axially disposed recess 23 in the insulating body 30 by the bent-over, resilient end 28.

FIG. 2*b* shows the insulating body 10, rotated by about 180° and viewed from the pressing/clamping part 30, so that the location of the contact element 25 on the surface of this side of the insulating body is clarified again. In this figure, it can also be seen that the axially disposed, lateral recess 23 has a stepped structure and that a projection 23' is also provided, around which the cable shielding is to be guided and via which the resilient end 28 of the contact part 25 engages in the recess 23.

As can also be seen from FIG. 2*a*, there is formed onto that side of the pressing/clamping part 30 which points towards the insulating body, a collar 32 which has raised polarising means 34 which engage in corresponding recesses 24 in the insulating body 20. A further recess 36, into which the contact element 25 reaches with the bent-over, resilient end 28, is also provided in the collar over the entire height of the latter. The cable shielding 52 is twisted prior to the assembly of the plug connector, and is threaded through the aperture 29 in the contact element. The individual conductors 54 are then pushed into the conductor-guiding ducts 22 in the insulating part, and the pressing/clamping part 30 is placed, with the contact element 25, on the insulating body 20. In the process, the twisted cable shielding is laid in the recess 23 which is formed in axially on the outer wall of the insulating body, the bent-over, resilient end 28 forcing the twisted cable shielding into the said recess. Individual conductor ends 54 and cable shielding which protrude beyond the insulating body are cut off, and the said insulating body is pushed into the carrier body 3 with the cable screw fitting. In the process, the individual conductors guided in the conductor-guiding ducts are cut by the insulation-piercing terminal contacts fixedly inserted in the carrier body (but not shown here), and at the same time an electrically conductive connection to the contact part 10 is produced. The screw bush 40 is then pushed on and screwed to the carrier body 3. In the process, the bent-over, resilient end 28 is inserted in a groove 5 provided for the purpose in the carrier body, and is pressed, with the bending edge 28', against the inner wall 42 of the outer screw fitting, so that, in addition to internal screening, second, electrically conductive outer screening thereby also takes place via the screw bush. However, this screening becomes active only when the bush 45 is drawn over the screw bush 40 and the plug-in part 2, so that the insulating part of the carrier body 3 is bridged, as shown in FIG. 3 in the case of the plug connector 1 which is represented in complete form.

The detail in FIG. 4 shows how the contact element 25 presses, with its bending edge 28', against the inner wall 42 of the metal screw bush 40 in order to pass on the potential of the cable screening 52 which is guided through the aperture 29 and rests against the resilient end 28. On the other side of the contact element 25, contact with the insulation-piercing terminal 19, which is positioned in the receptacle 21, is made with the aid of the angled portion 26 which is inserted in the receptacle 21'.

There is therefore the possibility of transmitting the potential of the screening inside the plug connector by means of the contact part 10 and the contact element 25 or via the outer cover by means of the screw bush 40 and the bush 45, or via both measures.

What is claimed is:

1. A Round plug connector for screened electric cables, the said connector having an insulating body disposed in a carrier body and a cable screw fitting comprising a pressing/clamping part and a metal screw bush, wherein the pressing/clamping part presses against the insulating body when the screw bush is screwed onto the carrier body, wherein (a) a contact element is provided for making contact with cable shielding on the electrical conductor, the said contact element being disposed on that side of the insulating body which points towards the cable connection;

(b) the contact element in the form of a flat, bending part is provided with a bent-over, resilient end which engages over a projection which is provided in a recess disposed axially in the outer wall of the insulating body;

(c) the contact element is provided with an aperture into which the cable shielding is introduced, the said cable shielding being received in the recess and clamped fast with the bent-over, resilient end; and (d) the contact element with the bent-over, resilient end is disposed in such a way that, when the screw bush is screwed on, the bending edge of the resilient end presses against the inner wall of the said screw bush.

2. The plug connector according to claim 1, wherein the contact element has, opposite the resilient end, an angled portion which penetrates into a slit in the insulating body.

3. The plug connector according to claim 1, wherein in that an insulation-piercing terminal, which makes contact with the angled portion of the contact element, is disposed in the slit.

4. The plug connector according to claim 1, wherein polarizers which interact with one another are provided on the insulating body and the pressing/clamping part.

5. The plug connector according to claim 1, wherein the insulating body is provided as a conductor-guiding part for electrical conductors with which contact is made by insulation-piercing terminals in suitably shaped conductor-guiding ducts.

* * * * *

UNITED STATES PATENT AND TRADEMARK OFFICE

CERTIFICATE OF CORRECTION

PATENT NO. : 6,716,041 B2
APPLICATION NO. : 10/410995
DATED : April 6, 2004
INVENTOR(S) : Ferderer et al.

It is certified that error appears in the above-identified patent and that said Letters Patent is hereby corrected as shown below:

On the title page, item (56), under "Foreign Patent Documents" add:
-- DE 19837530 8/19/1998
DE 29621436 12/10/1996--

Add subtitle at column 1, line 3:
-- BACKGROUND OF THE INVENTION --

Add subtitle at column 1, line 11:
-- BREIF DESCRIPTION OF THE PRIOR ART --

Add subtitle at column 1, line 23:
-- OBJECTS OF THE INVENTION --

Add subtitle at column 1, line 33:
-- SUMMARY OF THE INVENTION --

Cancel the paragraph "Advantageous refinements of the invention are indicated in claims 2 to 5." at column 1, lines 49 to 50.

Delete the word "and" in column 2, line 12.

Add --; and-- after the word "connector" in column 2, line 14.

Add subtitle at column 2, line 17:
-- DETAILED DESCRIPTION OF THE INVENTION --

Claim 1, Column 4, line 10, change "Round" to --round--.
Claim 1, Column 4, line 17, "on the electrical" should be --on an electrical--.
Claim 1, Column 4, line 17, delete the word "the" before the word "said".
Claim 1, Column 4, line 19, "towards the cable" should be --towards a cable--.
Claim 1, Column 4, line 24, "in the outer" should be --in an outer--.
Claim 1, Column 4, line 33, "against the inner" should be --against an inner--.

UNITED STATES PATENT AND TRADEMARK OFFICE

CERTIFICATE OF CORRECTION

PATENT NO. : 6,716,041 B2
APPLICATION NO. : 10/410995
DATED : April 6, 2004
INVENTOR(S) : Ferderer et al.

It is certified that error appears in the above-identified patent and that said Letters Patent is hereby corrected as shown below:

Claim 3, Column 4, line 37, "according to claim 1" should be --according to claim 2--.

Signed and Sealed this

Twenty-third Day of October, 2007

JON W. DUDAS
*Director of the United States Patent and Trademark Office*